United States Patent [19]

Gerharz

[11] Patent Number: 4,682,179

[45] Date of Patent: Jul. 21, 1987

[54] OMNIDIRECTIONAL ELECTROMAGNETIC LENS

[75] Inventor: Reinhold Gerharz, Bethesda, Md.

[73] Assignee: The United States of America as represented by the Secretary of the Army, Washington, D.C.

[21] Appl. No.: 730,013

[22] Filed: May 3, 1985

[51] Int. Cl.[4] ..... H01Q 15/02; H01Q 15/23

[52] U.S. Cl. ..... 343/755; 343/911 R

[58] Field of Search ..... 343/754, 755, 909, 910, 343/911 R, 911 L, 753, 773, 786; 350/1.1, 1.6, 1.7, 101, 103, 104, 106, 109, 162.11, 162.12, 409, 413, 416, 442, 444, 482, 483; 250/347, 353

[56] References Cited

U.S. PATENT DOCUMENTS 2,705,753 4/1955 Jaffe ..... 343/755

3,255,451 6/1966 Wolcott ..... 343/754 X 4,148,040 4/1979 Lunden et al. ..... 343/708

*Primary Examiner*—Marvin L. Nussbaum

*Attorney, Agent, or Firm*—Max L. Harwell; Aubrey J. Dunn; Anthony T. Lane

[57] ABSTRACT

An electromagnetic lens formed of a refractive material with a reflective surface. The lens is a body of revolution having an upper parabolic reflective surface and spherical side and bottom surfaces. Incoming radiation is refracted at one spherical surface, reflects from the reflective surface, exits and is refracted at the other spherical surface. The radiation may be directed onto an array of electromagnetic detectors. Such an array may consist of concentric circles of detectors, such that a particular detector is illuminated by incoming radiation of a particular azimuth and elevation.

1 Claim, 3 Drawing Figures

OMNIDIRECTIONAL ELECTROMAGNETIC LENS

The invention described herein may be manufactured, used, and licensed by the U.S. Government for governmental purposes without the payment of any royalties thereon.

BACKGROUND OF THE INVENTION

This invention is in the field of omnidirectional electromagnetic antennas. Various such antennas are known in the art—for r-f energy, the simplest is perhaps a so-called "whip" antenna, i.e., a vertical wire antenna. More complex (and higher grain) omnidirectional antennas are also known, such as those shown in the following U.S. Pat. No. 2,454,766 of Nov. 30, 1948 to Brillouin, U.S. Pat. No. 3,281,843 of Oct. 25, 1966 to Plummer, and U.S. Pat. No. 3,754,270 of Aug. 21, 1973 to Thies, Jr. For optical energy, some sort of aspherical refractive or reflective lens is used. All of the known antennas (lenses) have one or more disadvantage compared to the instant invention. Generally, if an omnidirectional antenna has good gain, it is narrow band; if it is omnidirectional and has good gain in a given plane, it generally has poor gain outside that plane. With the exception of the Thies patent, those patents cited above give no indication from which direction incident radiation comes. While the Thies antenna can give an indication of incident radiation azimuth direction, it has no means to determine elevation of such radiation. The instant invention is broadband, has a wide vertical beam width, and given an indication of both azimuth and elevation of incoming radiation.

SUMMARY OF THE INVENTION

The invention is a wide bandwidth omnidirectional electromagnetic lens capable of providing both azimuth and elevation information for incident electromagnetic radiation. The lens consists of a reflective paraboloid segment on a dielectric lens defined by spherical segments. An array of detectors may be used at the focus of the lens.

DETAILED DESCRIPTION OF INVENTION

Figure 1:
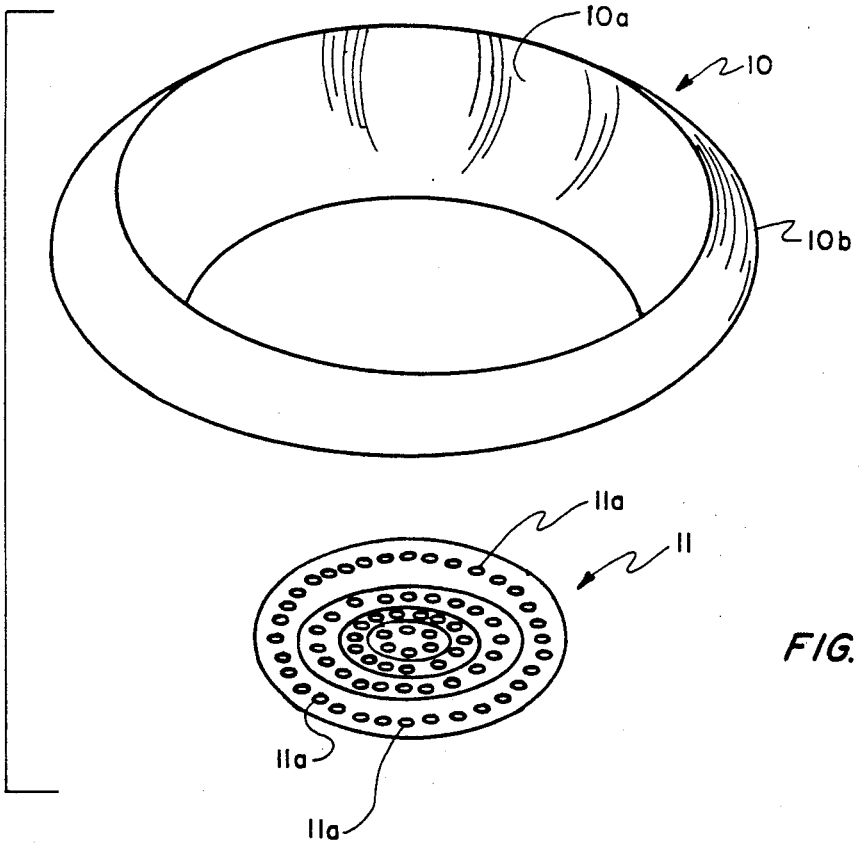
FIG. 1 is a schematic/isometric showing of the invention.

The invention might be best understood when this description is taken in conjunction with the drawings. FIG. 1 shows lens 10 juxtaposed to schematically shown detector array 11. Lens 10 consists of a top metallic reflective layer 10*a* on a ring of electromagnetic refractive material. This ring is a solid of revolution whose top surface (on which 10*a* is formed) is parabolic and whose side and bottom surfaces are segments of circles. Detector array 11 consists of elemental detectors 11*a* in concentric circles. Although not shown as such, each detector may include a dipole, r-f amplifier, etc., or may be a photodiode or photoresistor for optical frequencies; the particular elements are not part of or essential to the invention.

Figure 2:
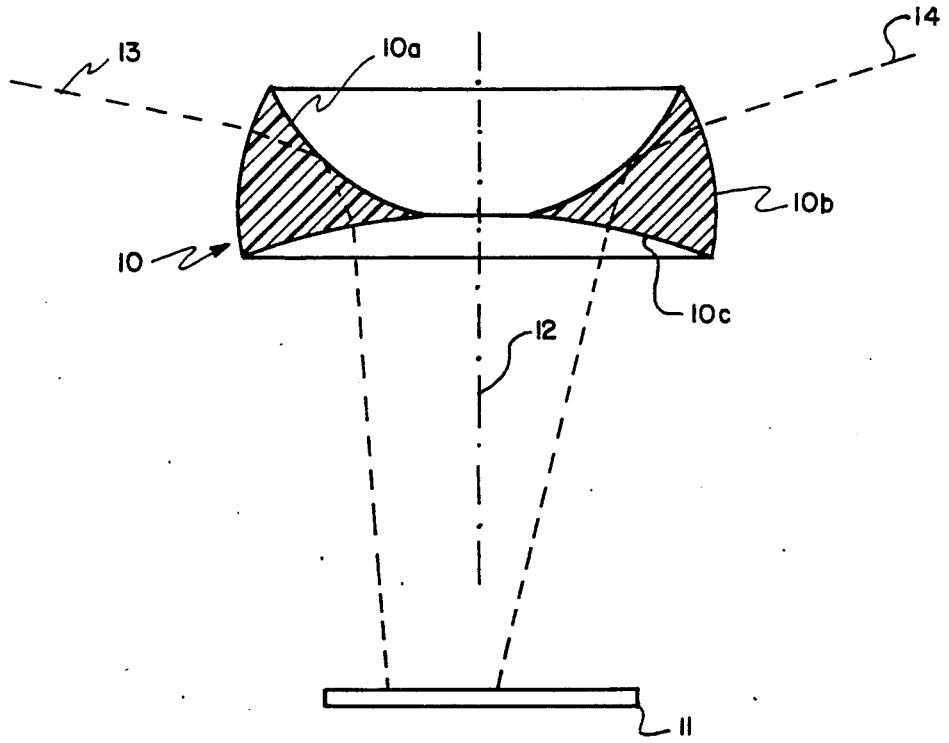
FIG. 2 is a sectional view of one embodiment of the invention.

FIG. 2 shows a side-sectional view of the invention; the surface of lens 10 atop which layer 10*a* lies is generated by a section of a parabola, and surfaces 10*b* and 10*c* are generated by sections of circles with centers on axis of revolution 12. The axis of the parabola is colinear with axis 12. This figure also shows some typical incident rays 13 and 14. Ray 13 strikes surface 10*b*, is refracted in 10, is reflected at surface 10*a*, is again refracted as it exits surface 10*c*, and falls on a detector in one of the concentric circles of detector array 11. Ray 14 enters 10, is refracted, is reflected from layer 10*a*, is refracted as it exits 10, and falls on a detector in a second concentric circle of the detector array. Thus, the particular detector on which a particular ray falls is indicative both of azimuth and elevation of the ray. Naturally, the ability of the inventive lens to discretely detect close incoming rays is dependent on the total number of detectors, i.e. the number of circles of detectors, multiplied by the number of detectors per circle. The maximum elevation angle at which a ray will still fall on a detector will depend on both the diameter of the detector array with respect to the lens, and the curvatures of the various surfaces. The antenna of FIG. 2 is omnidirectional as far as azimuth angles are concerned, but is restricted in elevation.

Figure 3:
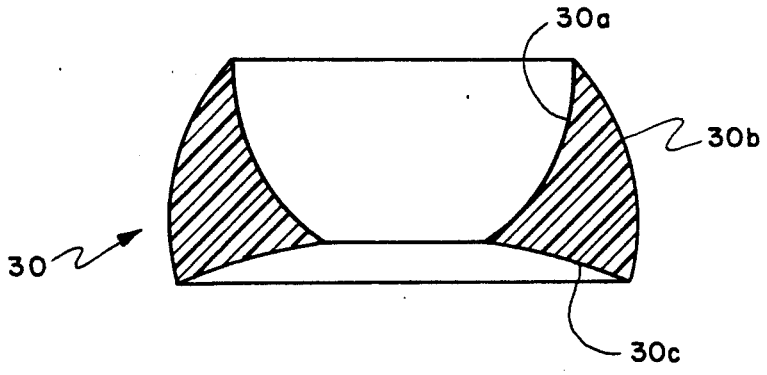
FIG. 3 is a sectional view of the lens for another embodiment of the invention.

FIG. 3 shows a cross-sectional view of another embodiment of the inventive lens. As can be seen, reflective layer 30*a* on lens 30 is a parabolic section with a wider shape than 10*a*. Surfaces 30*b* and 30*c* have the same radii as 10*a* and 10*b*, buth 30*b* subtends a larger one than 10*b*. This makes for a lens that is able to detect incident electromagnetic radiation over a greater elevation angle.

In a particular embodiment of the invention which I have built, and whose cross-section somewhat resembles that of FIG. 3, I chose a radius of 12.5 cm for the equivalent of surface 30*b*, 30 cm for 30*c* and made a parabola with a focal length of 3 cm corresponding to surface 30*a*. This gives me a lens with a spherical segment extending about 20° above and 15° below the equator of a sphere, and with a height of about 10.5 cm. The focal length of this lens is about 40 cm., and its field of view extends about 35° above and 10° below the spherical equator. The lens is of acrylic plastic with an aluminum reflective layer, and is unable over a very broad spectrum, extending from millimeter waves through visible, up to the infrared absorption region of the plastic. Of course, if the proper material is chosen for the lens, its response may be extended into the ultraviolet.

I claim:

1. An omnidirectional electromagnetic lens with a body of revolution about an axis of revolution and formed from a material transparent and refractive to electromagnetic waves and having three curved surfaces: a top reflective surface and transparent side and bottom surfaces, whereby said top surface is a segment of a paraboloid with an axis colinear to said axis of revolution, and said side and bottom surfaces are segments of spheres with their centers on said axis of revolution.

* * * * *